US006783693B1

(12) United States Patent
Aydin et al.

(10) Patent No.: US 6,783,693 B1
(45) Date of Patent: Aug. 31, 2004

(54) HYDRAULIC FLUIDS, CONTAINING CYCLIC CARBOXYLIC ACID DERIVATIVES

(75) Inventors: Bayram Aydin, Ludwigshafen (DE); Uwe Fidorra, Wachenheim (DE); Arthur Höhn, Kirchheim (DE); Ladislaus Meszaros, Ludwigshafen (DE); Jan Nouwen, Wachenheim (DE); Knut Oppenländer, Ludwigshafen (DE); Michael Roida, Weingarten (DE); Michael Stösser, Neuhofen (DE); Bernd Wenderoth, Birkenau (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/959,160

(22) PCT Filed: Apr. 11, 2000

(86) PCT No.: PCT/EP00/03230

§ 371 (c)(1),
(2), (4) Date: Oct. 18, 2001

(87) PCT Pub. No.: WO00/65001

PCT Pub. Date: Nov. 2, 2000

(30) Foreign Application Priority Data

Apr. 22, 1999 (DE) ..... 199 18 199

(51) Int. Cl.[7] ..... C09K 5/00
(52) U.S. Cl. ..... 252/77; 252/71; 252/78.1
(58) Field of Search ..... 252/77, 78.1, 71

(56) References Cited

U.S. PATENT DOCUMENTS 3,334,048 A * 8/1967 Hitchcock et al. ..... 252/77

FOREIGN PATENT DOCUMENTS

| | | | |
|---|---|---|---|
| DE | 17 68 933 | 4/1972 | |
| DE | 24 38 038 | 2/1975 | |
| DE | 28 04 535 | 8/1979 | |
| EP | 13 925 | 8/1980 | |
| FR | 2.209.830 | 7/1974 | |
| GB | 1323061 A * | 6/1969 | ..... C10M/3/30 |

* cited by examiner

*Primary Examiner*—Charles Boyer
*Assistant Examiner*—Derrick G. Hamlin
(74) *Attorney, Agent, or Firm*—Keil & Weinkauf

(57) ABSTRACT

Hydraulic fluids, in particular brake fluids for motor vehicles, comprising from 0.01 to 50 wt % of one or more cyclic carboxylates, or cyclic carboxamides, which can carry a linear or branched $C_1$-bis $C_{20}$ alkyl group on the nitrogen atom.

10 Claims, No Drawings

HYDRAULIC FLUIDS, CONTAINING CYCLIC CARBOXYLIC ACID DERIVATIVES

DESCRIPTION

The present invention relates to hydraulic fluids, in particular brake fluids for motor vehicles, containing from 0.01 to 50 wt % of one or more cyclic carboxylic derivatives of the general formula I

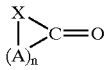

(I)

in which

X stands for an oxygen atom or a group of the formula N—$R^1$, in which $R^1$ denotes hydrogen or a linear or branched $C_1$–$C_{20}$ alkyl group, which can additionally be interspersed by up to 9 non-adjacent oxygen atoms and/or can carry up to 6 hydroxyl groups, or designates cycloalkyl or a (substituted) phenyl group, A denotes a group of the formula —$CR^2R^3$—, in which $R^2$ and $R^3$ stand for hydrogen or $C_1$–$C_8$ alkyl groups, which can additionally be interspersed by up to 4 non-adjacent oxygen atoms and/or can carry up to 3 hydroxyl groups, and n denotes a number from 2 to 7.

Hydraulic fluids and in particular brake fluids for motor vehicles must satisfy very high chemical and physical requirements. According to existing standards and specifications for brake fluids as issued by the US Department of Transportation in Federal Motor Vehicle Safety Standards FMVSS No. 116 and the Standard SAE J 1704 published by The Society of Automotive Engineers, modern brake fluids should have high dry boiling points (reflux boiling points, dry [Equilibrium reflux boiling point, "ERBP"]) and also high wet boiling points (reflux boiling points, wet ["wet ERBP"]), but on the other hand their viscosity should undergo only slight change over a wide temperature range. Furthermore, more extensive stipulations imposed by automotive engineers demand a low low-temperature viscosity in the presence of water.

However, hitherto known hydraulic fluids and brake fluids for motor vehicles are still unsatisfactory in this respect. Thus the object pursued here is to provide hydraulic fluids exhibiting the above properties.

Accordingly, we have found the hydraulic or power-transmitting fluids defined above.

The cyclic carboxylic derivatives of the general formula I are, in particular, cyclic carboxylic acid amides (lactams) and cyclic carboxylates (lactones), which can serve as precursors for the preparation of said lactams. In this case, the particularly preferred ring sizes used can comprise five-membered and six-membered ring systems. N—($C_1$–$C_{20}$ alkyl)-2-pyrrolidones are of particular interest.

The ring link X preferably stands for a group of the formula N—$R^1$.

The radical $R^1$ designates in addition to hydrogen, eg methyl, ethyl, n-propyl, isopropyl, n-butyl, isobutyl, sec-butyl, tert-butyl, n-pentyl, isopentyl, sec-pentyl, tert-pentyl, neopentyl, n-hexyl, cyclohexyl, phenyl, n-heptyl, n-octyl, 2-ethylhexyl, n-nonyl, isononyl, n-decyl, isodecyl, n-undecyl, n-dodecyl, n-tridecyl, isotridecyl, n-tetradecyl, n-hexydecyl, n-octadecyl, eicosyl, 2-hydroxyethyl, 2-hydroxypropyl, 3-hydroxypropyl, 4-hydroxybutyl, 2-methoxyethyl, 2-methoxypropyl, 3-methoxypropyl, 4-methoxybutyl, 2-hydroxy-3-methoxypropyl, 3-hydroxy-2-methoxypropyl, 2,3-dihydroxypropyl, 2,3-dimethoxypropyl and also alkylene-oxy groups of the formula —$(C_mH_{2m}O)_p$—Z—, in which m stands for 2, 3 or 4, p stands for a number from 1 to 9 (when m is 2) or from 1 to 6 (when m is 3) or from 1 to 5 (when m is 4) and Z denotes hydrogen or $C_1$–$C_4$ alkyl.

The radical $R^1$ preferably designates hydrogen or a linear or branched $C_1$–$C_6$ alkyl group which can additionally be interspersed by up to 3 non-adjacent oxygen atoms and/or can carry up to 2 hydroxyl groups, or designates a cyclohexyl or phenyl group.

The meanings stated for $R^1$ can also be applied to $R^2$ and $R^3$, for example. However, $R^2$ and $R^3$ preferably stand for hydrogen or methyl groups, primarily hydrogen.

The number n preferably denotes 2, 3 or 4, which will give ring sizes comprising four-membered to six-membered rings.

The cyclic carboxylic derivatives I are known substances which are commercially available or can be synthesized by commonly used manufacturing methods.

A preferred embodiment of the present invention comprises brake fluids for motor vehicles containing from 0.01 to 50 wt % of one or more of said cyclic carboxylic derivatives I. For both hydraulic fluids and brake fluids for motor vehicles, preferred contents of the compounds I are from 0.05 to 30 wt %, in particular from 0.1 to 20 wt % and more particularly from 0.5 to 10 wt %, based, in each case, on the total weight of the hydraulic fluid or brake fluid.

The presence of compounds I is an excellent way of ensuring that the hydraulic fluid or brake fluid for motor vehicles satisfies the aforementioned requirements and additionally clearly surpasses the more stringent demands placed by automotive engineers for a low low-temperature viscosity in the presence of water in addition to the demands of the specifications Dot 5 and Dot 5.1 for silicone-free brake fluids stipulated for brake fluids by the US Department of Transportation in Federal Motor Vehicle Safety Standards FMVSS No. 116. Thus compounds I can be used to reduce, ie, lower the viscosity, in particular the low temperature viscosity, of hydraulic fluids or brake fluids for motor vehicles, in the presence of water.

Important stipulations for brake fluids according to the Dot 5/Dot 5.1 specification are:

dry boiling point (Equilibrium reflux boiling point; "ERBP"): ≦260° C.

wet boiling point ("wetERBP"): ≧180° C.

kinematic viscosity at −40° C.("V"): ≦900 cSt an additional requirement imposed by automotive engineers for Dot 5.1 brake fluids is:

kinematic viscosity at −40° C. in the presence of 4% of water ("$V_{(4\%\ H_2O)}$"): ≦1200 cSt Further advantages of the hydraulic fluids and brake fluids for motor vehicles as proposed by the invention are their advantageous anticorrosive properties, good water-compatability, mild pH, good resistance to high and low temperatures and to oxidation and also good chemical stability, compatability with elastomers and rubber and good lubricating properties.

The brake fluids of the invention for use in motor vehicles also contain, in a preferred embodiment of the invention, from 0.1 to 97 wt %, particularly from 30 to 97 wt % and more particularly from 50 to 97 wt %, in each case based on the total weight of the brake fluid, of one or more polyethylene glycol ethers and/or their borates, in addition to compounds I.

Suitable polyethylene glycol ethers are primarily ethylene glycol monoalkyl ethers containing up to 6 ethylene oxide units and having up to 4 carbons in the alkyl group. Ethylene glycol dialkyl ethers or propylene glycol dialkyl ethers containing up to 6 alkylene oxide units and having up to 4 carbons in each of the alkyl groups are also suitable.

Suitable borates of the aforementioned or other polyglycol ethers are described, in particular, in specifications EP-B 013,925 (cyclic bisborates), DE-C 2,804,535 (nitrogen-containing borates) DE-A 2,438,038 (alkylene glycol monoalkyl ether borates) and DE-B 1,768,933 (alkyl trisalkoxyborates).

Instead of said polyethylene glycol ethers and/or their borates, the brake fluids of the invention for use in motor vehicles can also contain, as principal components, appropriate ethers and esters which are based on carboxylates, mineral oils or silicone fluids.

The brake fluids of the invention for use in motor vehicles further contain, in another preferred embodiment, from 0.1 to 50 wt %, particularly from 1 to 40 wt % and more particularly from 5 to 30 wt %, based on the total weight of the brake fluid, of one or more polyglycols, in addition to compounds I.

Suitable polyglycols are primarily higher-boiling reaction products of ethylene oxide and/or propylene oxide and/or butylene oxide with water or diols; in particular, appropriate reaction products of mixtures of ethylene oxide and propylene oxide with water are used. The number of alkylene oxide units in such polyglycols is normally from 2 to 10.

The action of these high-boiling polyglycols is that of a lubricant, which is mainly due to an improvement in the temperature/viscosity relationship. The polyglycols impart sufficient viscosity to the low-viscosity polyglycol ethers at high temperatures and thus provide adequate lubrication. Sufficient lubrication is necessary in the components of the motor vehicle brake system, since in said components rubber or elastomers have to slide against metal with minimum or no abrasion.

The brake fluids of the invention for use in motor vehicles further contain, in another preferred embodiment, from 0.01 to 10 wt %, particularly from 0.02 to 6 wt % and more particularly from 0.05 to 4 wt %, based on the total weight of the brake fluid, of one or more corrosion inhibitors, in addition to compounds I.

Corrosion inhibitors in brake fluids are intended to prevent the destruction of metallic materials caused by corrosion. Suitable corrosion inhibitors for this purpose are primarily alkali metal salts of orthophosphoric acid and phosphorous acid, fatty acids such as caprylic, lauric, palmitic, stearic or oleic acid and also their alkali metal salts, esters of orthophosphoric acid and phosphorous acid such as ethyl phosphate, dimethyl phosphate, isopropyl phosphate, diisopropyl phosphate, butyl phosphite or dimethyl phosphite, optionally ethoxylated mono- and di-alkylamines and their salts with mineral and fatty acids, eg butylamine, hexylamine, octylamine, isononylamine, oleylamine, dipropylamine, diisopropylamine or dibutylamine, optionally ethoxylated alkanolamines, eg mono-, di- or triethanolamine, N,N'-di-n-butylaminoethanol or 1,1'-iminodipropan-2-ol, cyclohexylamine, triazoles such as benzotriazole or tolutriazole and also nitroaromatics, eg 3-nitrobenzaldehyde.

Further components and auxiliaries in the brake fluids of the invention for use in motor vehicles can be conventional antioxidants, eg those based on phenol, and conventional defoamers.

UTILITARIAN EXAMPLES

Formulations containing a conventional motor vehicle brake fluid were prepared using the cyclic carboxylic derivatives listed below, which are commercially available or can be synthesized by conventional methods. The corresponding performance data for the brake fluids containing such additives were determined.

The motor vehicle brake fluid BF 1 used had the following composition (not considering compounds I):

75 wt % of methyl triglycol borate, 22 wt % of a mixture of methyl diglycol, methyl triglycol and methyl tetraglycol, <3 wt % of a mixture of N,N'-di-n-butylaminoethanol, 1,1'-iminodipropan-2-ol, tolutriazole and 3-nitrobenzaldehyde <0.5 wt % of bisphenol A In the formulations of the invention, based on BF 1, 5 wt % of methyl triglycol was exchanged for 5 wt % of the cyclic carboxylic derivatives of the invention.

The performance results were determined according to the methods described in FMVSS Standard No. 116 and SAE J 1704 and are listed in the table below:

| Additive | Conc. [wt %] | V [cSt] | $V_{(4\%H_2O)}$ [cSt] | wet ERBP [° C.] | ERBP [° C.] |
|---|---|---|---|---|---|
| N-methyl-pyrrolidone-2 | 5 | 702 | 1058 | 184 | 269 |
| N-isopropyl-pyrrolidone-2 | 5 | 748 | 1136 | 187 | 269 |
| N-sec-butyl-pyrrolidone-2 | 5 | 772 | 1163 | 186 | 267 |
| N-tert-butyl-pyrrolidone-2 | 5 | 790 | 1196 | 184 | 263 |
| N-n-butyl-pyrrolidone-2 | 5 | 757 | 1141 | 185 | 269 |
| N-n-pentyl-pyrrolidone-2 | 5 | 797 | 1190 | 186 | 269 |
| N-n-hexyl-pyrrolidone-2 | 5 | 790 | 1175 | 184 | 270 |
| for comparison: | | | | | |
| BF 1 | — | 833 | 1223 | 181 | 269 |
| Hydraulan ® 508 | — | 795 | 1334 | 181 | 269 |
| DOT 5.1 Brake Fluid ® | — | 900 | 1265 | 180 | 262 |

It is seen that, unlike conventional Dot 5.1 brake fluids such as Hydraulan 508 of BASF Aktiengesellschaft or Dot 5.1 Brake Fluid of Motul S.A. (France), the formulations of the invention satisfy, in addition to the demands of Dot 5.1 Specification, the more stringent demand for a low viscosity at −40° C. in the presence of 4% of water [B Z7 Lam>(4% H2O)≦1,200 cSt].

We claim:

1. A hydraulic fluid, comprising from 0.01 to 10 wt % of one or more cyclic carboxylic derivatives of the general formula I

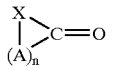

(I)

in which

X stands for an oxygen atom or a group of the formula N—$R^1$, in which $R^1$ denotes hydrogen or a linear or branched $C_1$–$C_{20}$ alkyl group, which can additionally be interspersed by up to 9 non-adjacent oxygen atoms and/or can carry up to 6 hydroxyl groups, or designates cycloalkyl or a (substituted) phenyl group, A denotes a group of the formula —$CR^2R^3$—, in which $R^2$ and $R^3$ stand for hydrogen or $C_1$–$C_8$ alkyl groups, which can additionally be interspersed by up to 4 non-adjacent oxygen atoms and/or can carry up to 3 hydroxyl groups, and n denotes a number from 2 to 7.

2. A hydraulic fluid as defined in claim 1, comprising one or more carboxylic derivatives I in which X stands for a group of the formula N—$R^1$.

3. A hydraulic fluid as defined in claim 1, comprising one or more carboxylic derivatives I in which $R^1$ designates hydrogen or a linear or branched $C_1$–$C_6$ alkyl group which can additionally be interspersed by up to 3 non-adjacent oxygen atoms and/or can carry up to 2 hydroxyl groups.

4. A hydraulic fluid as defined in claim 1, comprising one or more carboxylic derivatives I in which $R^2$ and $R^3$ stand for hydrogen or methyl.

5. A hydraulic fluid as defined in claim 1, comprising one or more carboxylic derivatives I in which n denotes 2, 3 or 4.

6. A motor vehicle brake fluid, comprising from 0.01 to 10 wt % of one or more cyclic carboxylic derivatives as defined in claim 1.

7. A motor vehicle brake fluid as defined in claim 6, comprising, in addition to compounds I, from 0.1 to 95 wt % of one or more polyethylene glycol ethers and/or the borates thereof.

8. A motor vehicle brake fluid as defined in claim 6, comprising, in addition to compounds I, from 0.1 to 50 wt % of one or more polyglycols.

9. A motor vehicle brake fluid as defined in claim 6, comprising, in addition to compounds I, from 0.1 to 10 wt % of one or more corrosion inhibitors.

10. A method of lowering the viscosity, particularly the low-temperature viscosity in the presence of water, of hydraulic fluids by using one or more cyclic carboxylic derivatives of Formula I as defined in claim 1 in a concentration of from 0.01 to 50 wt %, in particular from 0.01 to 10 wt %, based on the hydraulic fluid.

* * * * *